US010916851B2

(12) United States Patent
Wei et al.

(10) Patent No.: US 10,916,851 B2
(45) Date of Patent: Feb. 9, 2021

(54) MOBILE ELECTRONIC DEVICE

(71) Applicant: Acer Incorporated, New Taipei (TW)

(72) Inventors: Wan-Chu Wei, New Taipei (TW); Hsieh-Chih Lin, New Taipei (TW); Hsin-Wu Chiang, New Taipei (TW); Pei-Chi Ma, New Taipei (TW); Yu-Chia Chang, New Taipei (TW); Pang-Chun Tsai, New Taipei (TW); Chung-hao Huang, New Taipei (TW)

(73) Assignee: Acer Incorporated, New Taipei (TW)

( * ) Notice: Subject to any disclaimer, the term of this patent is extended or adjusted under 35 U.S.C. 154(b) by 223 days.

(21) Appl. No.: 15/943,722

(22) Filed: Apr. 3, 2018

(65) Prior Publication Data

US 2019/0074590 A1 Mar. 7, 2019

(30) Foreign Application Priority Data

Sep. 4, 2017 (TW) ..... 106130165 A

(51) Int. Cl.
*H01Q 1/24* (2006.01)
*H01Q 21/28* (2006.01)
(Continued)

(52) U.S. Cl.
CPC ..... *H01Q 9/0407* (2013.01); *H01Q 1/2275* (2013.01); *H01Q 1/243* (2013.01); *H01Q 1/521* (2013.01); *H01Q 21/28* (2013.01)

(58) Field of Classification Search
CPC ..... H01Q 1/2275; H01Q 1/24; H01Q 1/241; H01Q 1/242; H01Q 1/243; H01Q 1/521; H01Q 9/0407; H01Q 21/28; H01Q 5/30; H01Q 5/307; H01Q 5/314; H01Q 5/328; H01Q 5/50; H01Q 1/523; H01Q 1/525
See application file for complete search history.

(56) References Cited

U.S. PATENT DOCUMENTS 8,378,900 B2 * 2/2013 Hyvonen ..... H01Q 1/48 343/702
8,816,912 B2 * 8/2014 Rajgopal ..... H01P 1/203 343/702
10,418,700 B2 * 9/2019 Harper ..... H01Q 1/38

FOREIGN PATENT DOCUMENTS

CN 103682627 3/2014
CN 103811868 5/2014
(Continued)

*Primary Examiner* — Dimary S Lopez Cruz
*Assistant Examiner* — Patrick R Holecek
(74) *Attorney, Agent, or Firm* — JCIPRNET

(57) ABSTRACT

A mobile electronic device includes a ground plane, a first slot, a plurality of first inductive elements, a first antenna, a second antenna, a first signal source, and a second signal source. The first slot is disposed in the ground plane to form a first ground portion and a second ground portion separated from each other. The first inductive elements are respectively connected to the first ground portion and the second ground portion. The first antenna and the second antenna respectively receive a radio-frequency signal in a predetermined band. The first signal source is electrically connected between the first antenna and the first ground portion and receives the radio-frequency signal from the first antenna. The second signal source is electrically connected between the second antenna and the second ground portion and receives the radio-frequency signal from the second antenna.

8 Claims, 4 Drawing Sheets

(51) Int. Cl.

| | |
|---|---|
| ***H01Q 1/52*** | (2006.01) |
| ***H01Q 9/04*** | (2006.01) |
| ***H01Q 1/22*** | (2006.01) |

(56) References Cited

FOREIGN PATENT DOCUMENTS

| | | |
|---|---|---|
| CN | 104638365 | 5/2015 |
| CN | 105514606 | 4/2016 |
| CN | 106558752 | 4/2017 |
| KR | 20150072119 | 6/2015 |

* cited by examiner

MOBILE ELECTRONIC DEVICE

CROSS-REFERENCE TO RELATED APPLICATION

This application claims the priority benefit of Taiwan application serial no. 106130165, filed on Sep. 4, 2017. The entirety of the above-mentioned patent application is hereby incorporated by reference herein and made a part of this specification.

BACKGROUND OF THE INVENTION

1. Field of the Invention

The invention relates to a mobile electronic device. More particularly, the invention relates to a mobile electronic device including a first antenna and a second antenna.

2. Description of Related Art

Along with technology advances, a variety of mobile electronic devices, such as the USB wireless network cards, Smartphones, tablet computers, etc. can be found everywhere in people's life. Taking the USB wireless network cards for example, the USB wireless network cards are equipped with advantages such as compact sizes and light weights, so as to be carried and used by the users conveniently. Besides, a plurality of antennas have to be correspondingly disposed in an USB wireless network card in order to satisfy requirement of multi-band operation. Nevertheless, the hardware space of the USB wireless network card is more limited compare to that of a Smartphone. As such, the antennas in the USB wireless network card tend to interfere with one another, and consequently, antenna efficiency and communication quality are affected. Particularly, when being operated in a low frequency band, interference between the antennas becomes even more evident. Therefore, how to improve isolation between the antennas has become an important issue in the design of the mobile electronic devices.

SUMMARY OF THE INVENTION

The invention provides a mobile electronic device in which a plurality of first inductive elements are electrically connected a first ground portion and a second ground portion separated from each other, and a first signal source and a second signal source corresponding to a first antenna and a second antenna are electrically connected to the first ground portion and the second ground portion. As such, isolation between the first antenna and the second antenna may be improved and communication quality of the mobile electronic device may be enhanced.

In an embodiment of the invention, a mobile electronic device includes a ground plane, a first slot, a plurality of first inductive elements, a first antenna, a second antenna, a first signal source, and a second signal source. The first slot disposed in the ground plane to form a first ground portion and a second ground portion separated from each other. The first inductive elements are electrically connected to the first ground portion and the second ground portion, respectively. The first antenna and the second antenna respectively receive a radio-frequency signal in a predetermined band. The first signal source is electrically connected between the first antenna and the first ground portion and receives the radio-frequency signal from the first antenna. The second signal source is electrically connected between the second antenna and the second ground portion and receives the radio-frequency signal from the second antenna.

To sum up, in the mobile electronic device provided by the embodiments of the invention, the first slot is disposed in the ground plane to form the first ground portion and the second ground portion separated from each other. Moreover, the first ground portion is electrically connected to the second ground portion through the first inductive elements. The first signal source and the second signal source corresponding to the first antenna and the second antenna are electrically connected to the first ground portion and the second ground portion, respectively. As such, the isolation between the first antenna and the second antenna may be improved and the communication quality of the mobile electronic device may be enhanced.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
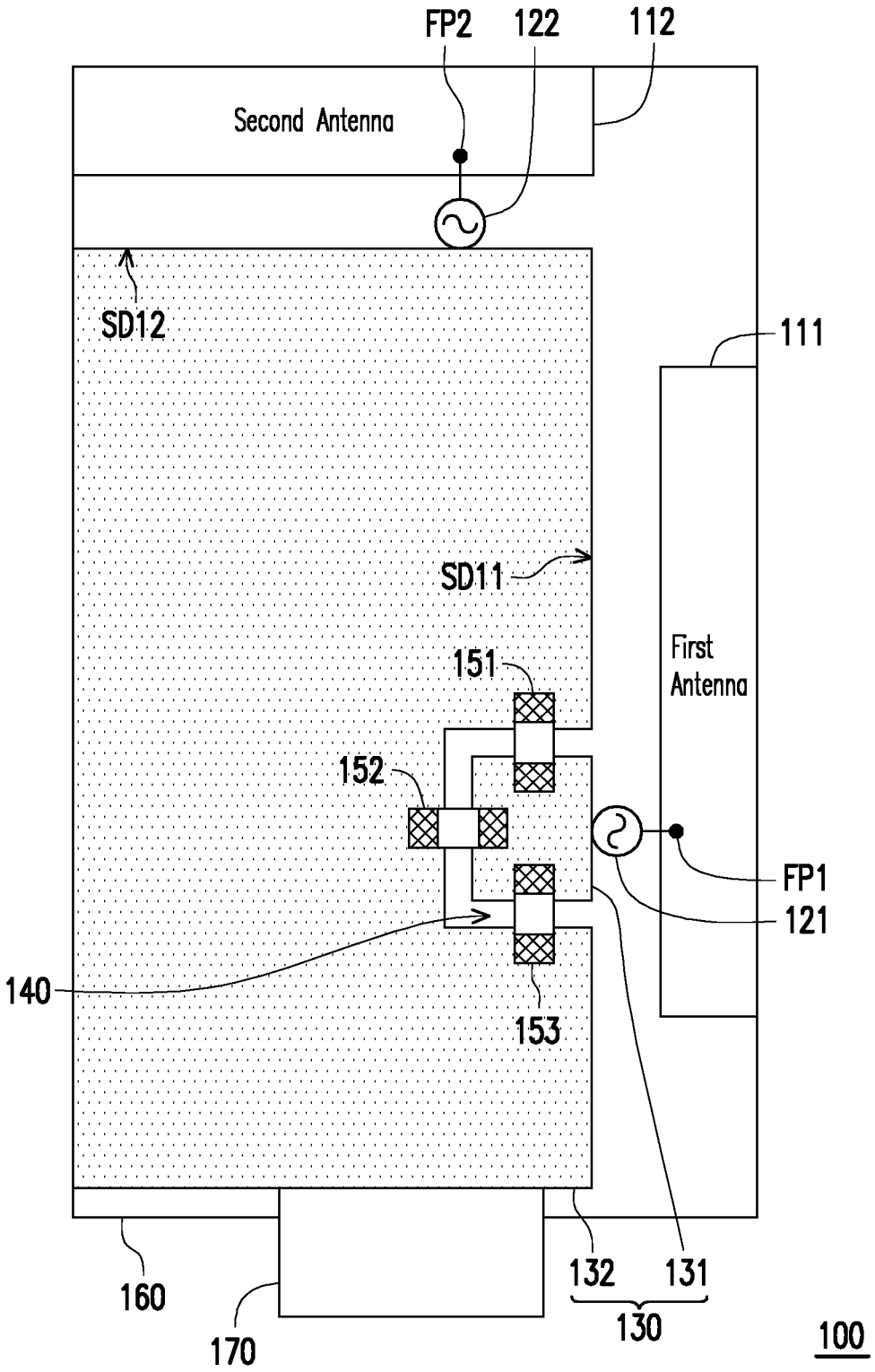
FIG. 1 is a schematic view of a mobile electronic device according to an embodiment of the invention.

FIG. 1 is a schematic view of a mobile electronic device according to an embodiment of the invention. As shown in FIG. 1, a mobile electronic device 100 includes a first antenna 111, a second antenna 112, a first signal source 121, a second signal source 122, a ground plane 130, a first slot 140, and a plurality of first inductive elements 151 to 153.

The first antenna 111 and the second antenna 112 may respectively receive a radio-frequency signal in a predetermined band. For instance, the first antenna 111 and the second antenna 112 may respectively cover the reception band under the LTE (Long Term Evolution) communication standard, so as to respectively receive the radio-frequency signal in the LTE band. In addition, the second antenna 112 may further cover the transmission band under the LTE communication standard, so as to transmit the radio-frequency signal in the LTE band. In other words, the second antenna 112 may be equivalent to a main antenna of the mobile electronic device 100, and the first antenna 111 may be equivalent to a secondary antenna of the mobile electronic device 100. In addition, the mobile electronic device 100 may support the multi-input multi-output (MIMO) technology under the LTE communication standard through the first antenna 111 and the second antenna 112.

It should be noted that the first slot 140 is disposed in the ground plane 130 and is configured to divide the ground plane 130 into a first ground portion 131 and a second ground portion 132 separated from each other. In other words, the ground plane 130 may be divided into the first ground portion 131 and the second ground portion 132 which are electrically disconnected through the first slot 140. The first inductive elements 151 to 153 respectively cross the first slot 140 and are arranged in sequence along the first slot 140. In addition, the first inductive elements 151 to 153 are electrically connected to the first ground portion 131 and the second ground portion 132, respectively. In other words, the first ground portion 131 may be electrically connected to the second ground portion 132 through the first inductive elements 151 to 153.

The first signal source 121 is electrically connected between the first antenna 111 and the first ground portion 131, and the second signal source 122 is electrically connected between the second antenna 112 and the second ground portion 132. In addition, the first signal source 121 and the second signal source 122 may be respectively a wireless communication element, such as a wireless transceiver. In operation, the first signal source 121 may receive the radio-frequency signal from a feeding point FP1 of the first antenna 111 or provide a feeding signal to the feeding point FP1 of the first antenna 111. Alternatively, the second signal source 122 may receive the radio-frequency signal from a feeding point FP2 of the second antenna 112 or provide a feeding signal to the feeding point FP2 of the second antenna 112.

In other words, the first antenna 111 and the second antenna 112 are electrically connected to the different first and second signal sources 121 and 122. Besides, the first signal source 121 and the second signal source 122 are electrically connected to the different first and second ground portions 131 and 132, i.e., the two ground portions 131 and 132 that are separated from each other or are independent of each other. Furthermore, the first ground portion 131 and the second ground portion 132 separated from each other or independent of each other may be electrically connected to each other through the first inductive elements 151 to 153. As such, mutual interference between the first antenna 111 and the second antenna 112 may be reduced, such that isolation between the first antenna 111 and the second antenna 112 may be improved and communication quality of the mobile electronic device 100 may be enhanced.

Figure 2:
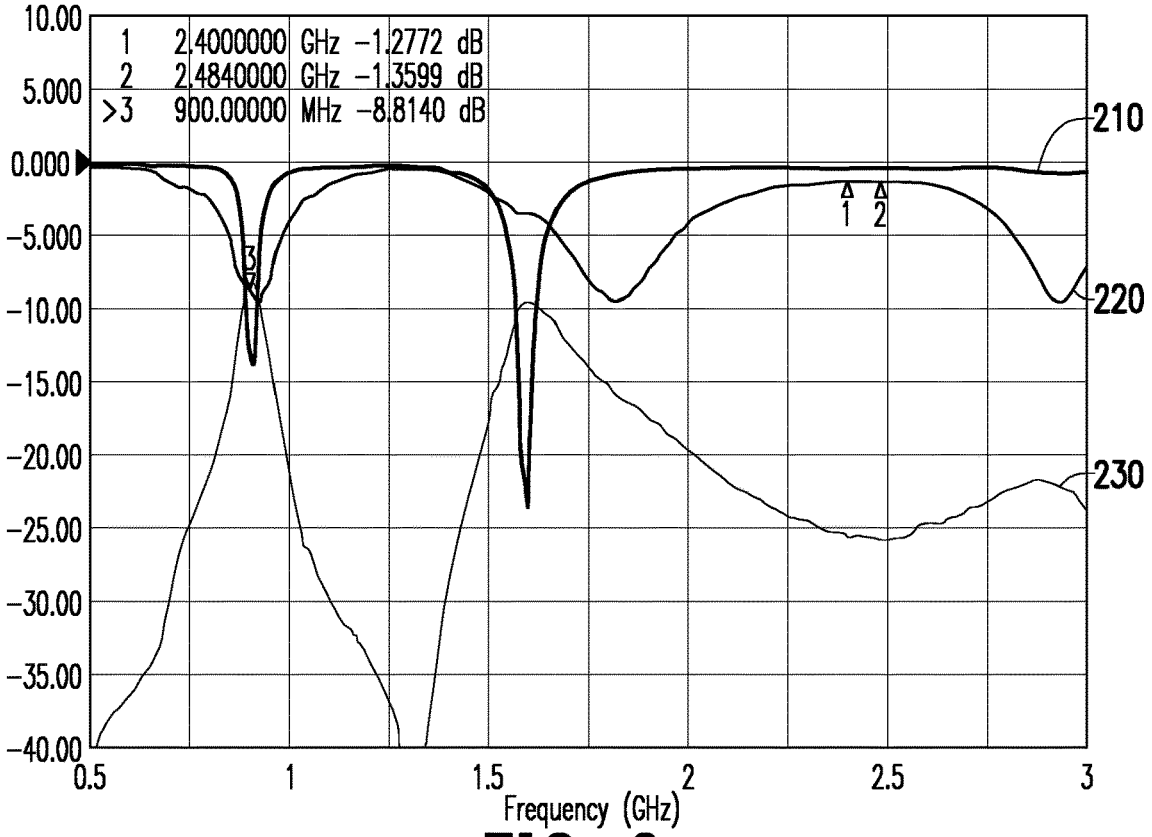
FIG. 2 is an S parameter curve diagram of the mobile electronic device of FIG. 1 without the first slot and the first inductive elements.

For instance, FIG. 2 is an S parameter curve diagram of the mobile electronic device of FIG. 1 without the first slot and the first inductive elements. Taking the embodiment of FIG. 2 for example, a size of the ground plane 130 is approximately 77×29 $mm^2$. In addition, under the condition that the first slot 140 and the first inductive elements 151 to 153 are not disposed, reflection coefficients of the first antenna 111 and the second antenna 112 are respective shown by a curve 210 and a curve 220, and isolation between the first antenna 111 and the second antenna 112 is shown by a curve 230.

Figure 3:
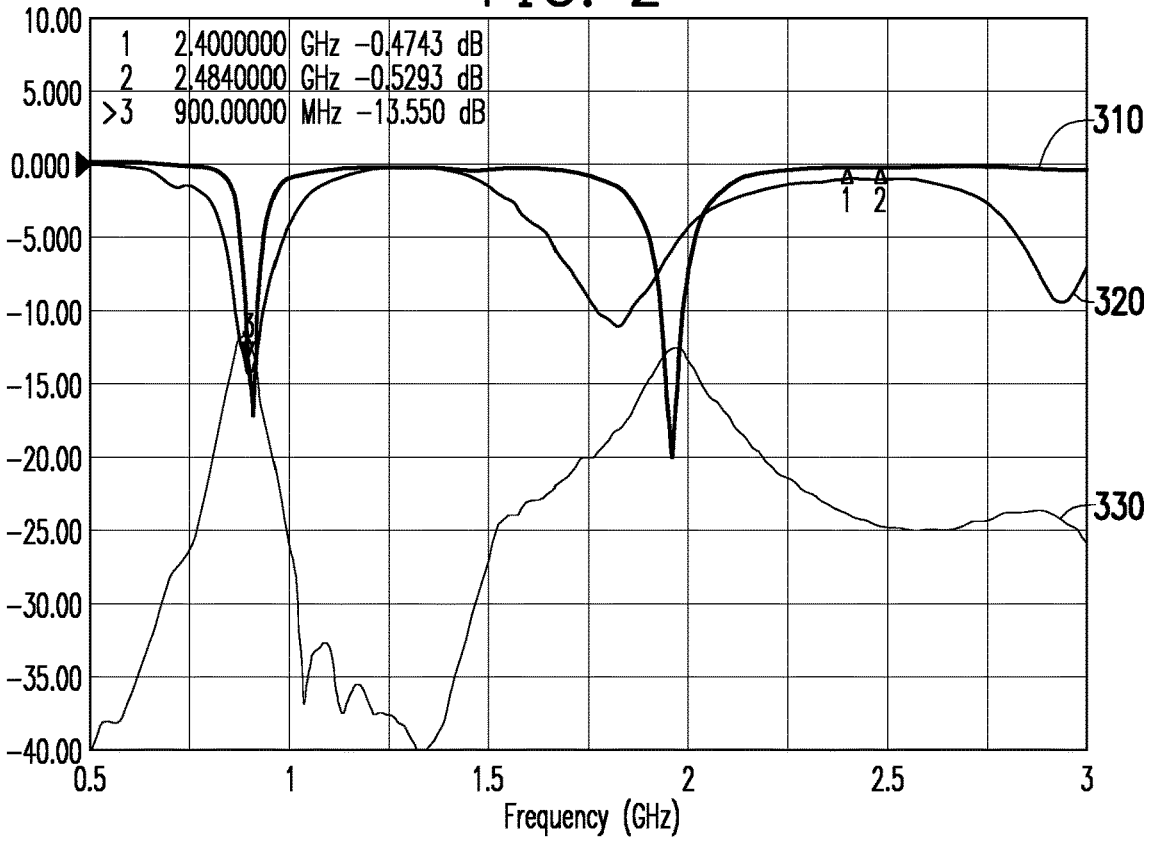
FIG. 3 is an S parameter curve diagram of the mobile electronic device of FIG. 1 with the first slot and the first inductive elements.

FIG. 3 is an S parameter curve diagram of the mobile electronic device of FIG. 1 with the first slot and the first inductive elements. Taking the embodiment of FIG. 3 for example, a size of the ground plane 130 is approximately 77×29 $mm^2$. A width of the first slot 140 is approximately 3 mm. A size of the first ground portion 131 divided from the ground plane 130 in response to the first slot 140 is approximately 10×8 $mm^2$. The first inductive elements 151 to 153 may be respectively a chip inductor of 8.2 nH. In addition, under the condition that the first slot 140 and the first inductive elements 151 to 153 are disposed, the reflection coefficients of the first antenna 111 and the second antenna 112 are respective shown by a curve 310 and a curve 320, and the isolation between the first antenna 111 and the second antenna 112 is shown by a curve 330.

Referring to FIG. 2 and FIG. 3, the first antenna 111 and the second antenna 112 may be respectively a dual band antenna, and the predetermined band covered by the first antenna 111 and the second antenna 112 is 900 MHz. As shown in FIG. 2, under the condition that the first slot 140 and the first inductive elements 151 to 153 are not disposed, the reflection coefficients of the first antenna 111 and the second antenna 112 in the predetermined band are respectively be −13 dB and −8.8 dB, and the isolation of the first antenna 111 and the second antenna 112 in the predetermined band is −8.5 dB. As shown in FIG. 3, under the condition that the first slot 140 and the first inductive elements 151 to 153 are disposed, the reflection coefficients of the first antenna 111 and the second antenna 112 in the predetermined band are respectively be −13 dB and −15 dB, and the isolation of the first antenna 111 and the second antenna 112 in the predetermined band is −12 dB. In other words, under the condition that the first slot 140 and the first inductive elements 151 to 153 are disposed, the isolation between the first antenna 111 and the second antenna 112 is significantly improved, and performance of the second antenna 112 in the predetermined band is considerably enhanced.

Referring to FIG. 1 continuously, a detailed structure of the mobile electronic device 100 is described as follows. The ground plane 130 includes a first edge SD11 and a second edge SD12. The first antenna 111 is adjacent to the first edge SD11 of the ground plane 130. The second antenna 112 is adjacent to the second edge SD12 of the ground plane 130. The first slot 140 surrounds the first ground portion 131 and has two openings located at the first edge SD11. As such, the first ground portion 131 and the second ground portion 132 may be separated from each other through the first slot 140. The first inductive elements 151 to 153 are dispersed around the first ground portion 131, so as to be electrically connected to the first ground portion 131 and the second ground portion 132, respectively.

The mobile electronic device 100 further includes a substrate 160 and a connector 170. The first antenna 111, the second antenna 112, the first signal source 121, the second signal source 122, the ground plane 130, and the connector 170 are disposed on the substrate 160. Besides, in this embodiment, the connector 170 may be, for example, a universal serial bus (USB) connector, and the mobile electronic device 100 may be, for example, an USB wireless network card. In another embodiment, the mobile electronic device 100 may also be, for example, a Smartphone or a tablet computer.

Figure 4:
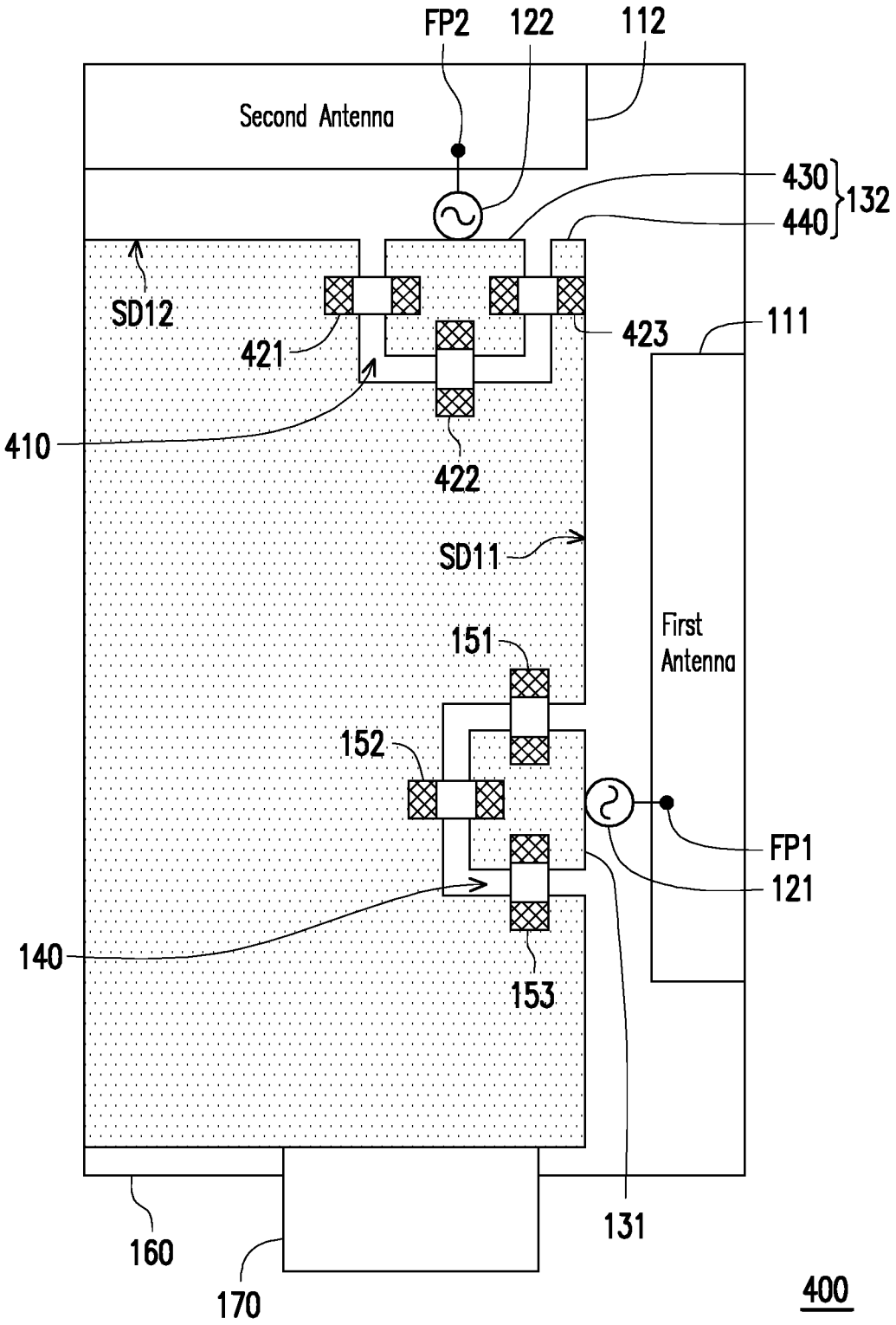
FIG. 4 is a schematic view of a mobile electronic device according to another embodiment of the invention.

FIG. 4 is a schematic view of a mobile electronic device according to another embodiment of the invention. Comparing to the embodiment of FIG. 1, a mobile electronic device 400 of FIG. 4 further includes a second slot 410 and a plurality of second inductive elements 421 to 423.

Specifically, the second slot 410 is disposed in the second ground portion 132 to form a third ground portion 430 and a fourth ground portion 440 separated from each other. The second slot 410 surrounds the third ground portion 430 and has two openings located at the second edge SD12. As such, the third ground portion 430 and the fourth ground portion 440 may be separated from each other through the second slot 410. The second inductive elements 421 to 423 are dispersed around the third ground portion 430. For instance, the second inductive elements 421 to 423 are arranged in sequence along the second slot 410. Besides, the second inductive elements 421 to 423 cross the second slot 410 and are electrically connected to the third ground portion 430 and the fourth ground portion 440, respectively. The second signal source 122 is electrically connected between the second antenna 112 and the third ground portion 430.

In other words, the corresponding second slot 410 is further disposed on the mobile electronic device 400 in response to the second signal source 112, so as to further divide the second ground portion 132 into the third ground portion 430 and the fourth ground portion 440. In addition, the third ground portion 430 may be electrically connected to the fourth ground portion 440 through the second inductive elements 421 to 423. As such, mutual interference between the first antenna 111 and the second antenna 112 may be further reduced, such that the isolation between the first antenna 111 and the second antenna 112 may be improved. The detailed configuration and operation of each of the elements in the embodiment of FIG. 4 are included in the embodiment of FIG. 1 and thus not repeated herein.

It should be noted that the first antenna 111 and the second antenna 112 may respectively be constituted by an antenna of any type, such as a planar inverted F antenna (PIFA), a monopole antenna, a dipole antenna, or a loop antenna, etc. In addition, when the first antenna 111 has a first shorting end, the first shorting end of the first antenna 111 and the first signal source 121 may be electrically connected to the same ground portion or to different ground portions. Alternatively, when the second antenna 112 has a second shorting end, the second shorting end of the second antenna 112 and the second signal source 122 may be electrically connected to the same ground portion or to different ground portions.

Figure 5:
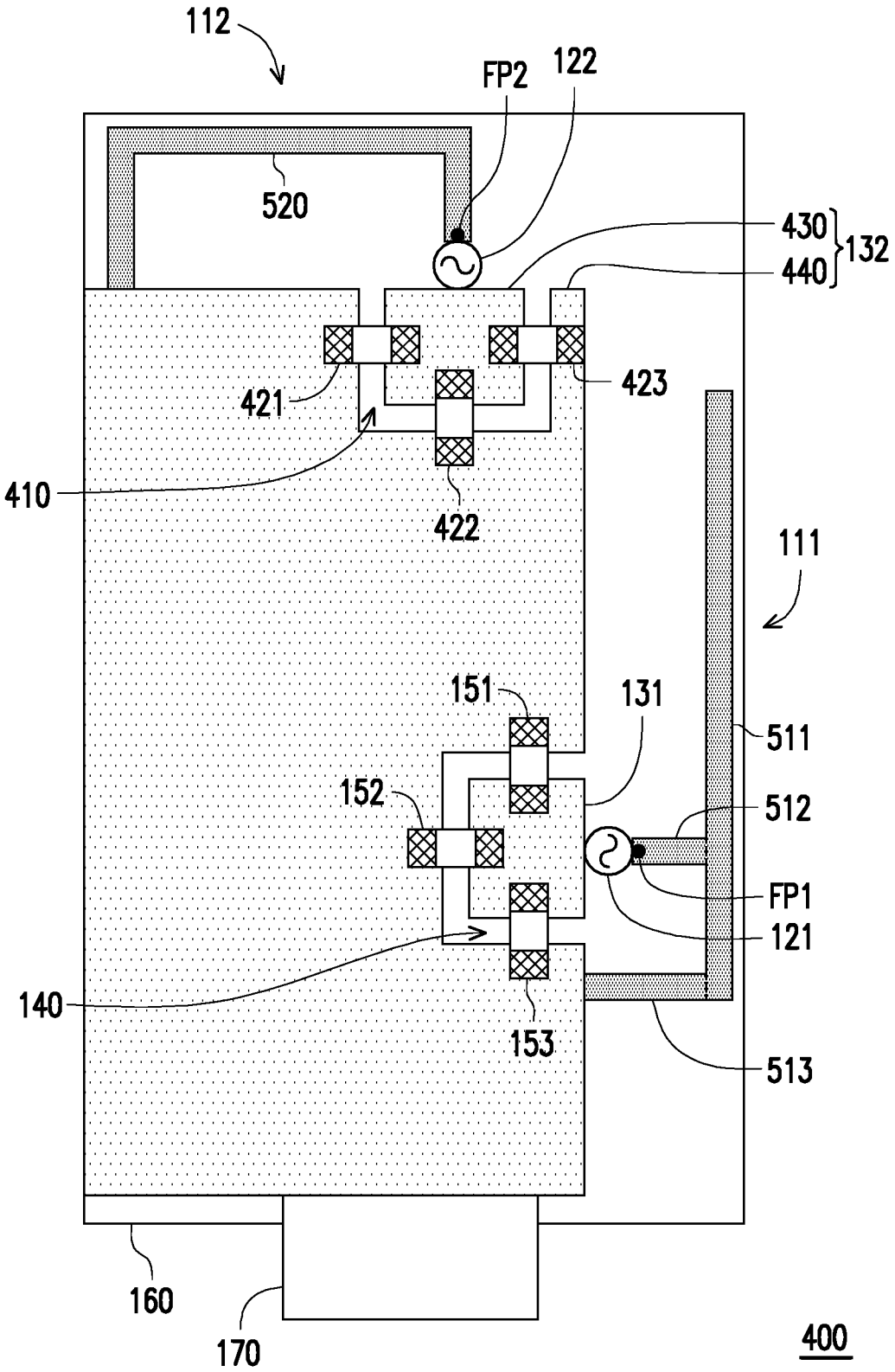
FIG. 5 is a schematic view of a mobile electronic device according to yet another embodiment of the invention.

For instance, FIG. 5 is a schematic view of a mobile electronic device according to yet another embodiment of the invention. As shown in FIG. 5, the first antenna 111 may be, for example, a planar inverted F antenna and includes a radiation portion 511, a feeding portion 512, and a shorting portion 513. A first end of the feeding portion 512 has the feeding point FP1, and a second end of the feeding portion 512 is electrically connected to the radiation portion 511. A first end of the shorting portion 513 is configured to form the first shorting end of the antenna 111, and a second end of the shorting portion 513 is electrically connected to the radiation portion 511. In the embodiment of FIG. 5, the first shorting end of the first antenna 111, i.e., the first end of the shorting portion 513, is electrically connected to the fourth ground portion 440 in the second ground portion 132. In another embodiment, the first shorting end of the first antenna 111 may also be electrically connected to the first ground portion 131.

The second antenna 112 may be, for example, a loop antenna and includes a radiation portion 520. A first end of the radiation portion 520 has the feeding point FP2, and a second end of the radiation portion 520 is configured to form the second shorting end of the second antenna 112. In the embodiment of FIG. 5, the second shorting end of the second antenna 112, i.e., the second end of the radiation portion 520, is electrically connected to the fourth ground portion 440. In another embodiment, the second shorting end of the second antenna 112 may also be electrically connected to the third ground portion 430. The detailed configuration and operation of each of the elements in the embodiment of FIG. 5 are included in the embodiments in FIG. 1 and FIG. 4 and thus not repeated herein.

In view of the foregoing, in the mobile electronic device provided by the embodiments of the invention, the ground plane may be divided into the first ground portion and the second ground portion through the first slot, and the first ground portion may be electrically connected to the second ground portion through the first inductive elements. In addition, the first signal source and the second signal source corresponding to the first antenna and the second antenna may be electrically connected to the first ground portion and the second ground portion, respectively. As such, the mutual interference between the first antenna and the second antenna may be reduced, such that the isolation between the first antenna and the second antenna may be improved and the communication quality of the mobile electronic device may be enhanced. In another embodiment, the corresponding second slot and the second inductive elements are further disposed on the mobile electronic device in response to the second signal source, so as to further improve the isolation between the first antenna and the second antenna.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A mobile electronic device, comprising:

a ground plane;

a first slot disposed in the ground plane to form a first ground portion and a second ground portion separated from each other, wherein the first ground portion and the second ground portion are electrically disconnected through the first slot, wherein the first slot surrounds the first ground portion;

a plurality of first inductive elements electrically connected to the first ground portion and the second ground portion, respectively;

a first antenna and a second antenna respectively receiving a radio-frequency signal in a predetermined band, wherein the first antenna is adjacent to a first edge of the ground plane, and the first slot has two openings located at the first edge;

a first signal source electrically connected between the first antenna and the first ground portion and receiving the radio-frequency signal from the first antenna; and a second signal source electrically connected between the second antenna and the second ground portion and receiving the radio-frequency signal from the second antenna.

2. The mobile electronic device as claimed in claim 1, wherein the first antenna comprises a first shorting end, and the first shorting end is electrically connected to the second ground portion.

3. The mobile electronic device as claimed in claim 1, further comprising:

a second slot disposed in the second ground portion to form a third ground portion and a fourth ground portion separated from each other, wherein the second signal source is electrically connected between the second antenna and the third ground portion; and a plurality of second inductive elements crossing the second slot and electrically connected to the third ground portion and the fourth ground portion, respectively.

4. The mobile electronic device as claimed in claim 3, wherein the second slot surrounds the third ground portion.

5. The mobile electronic device as claimed in claim 3, wherein the first antenna is adjacent to a first edge of the ground plane, the second antenna is adjacent to a second edge of the ground plane, the first slot has two openings located at the first edge, and the second slot has two openings located at the second edge.

6. The mobile electronic device as claimed in claim 3, wherein the first antenna comprises a first shorting end, the second antenna comprises a second shorting end, and the first shorting end and the second shorting end are electrically connected to the fourth ground portion.

7. The mobile electronic device as claimed in claim 3, wherein the first inductive elements are sequentially arranged along the first slot, and the second inductive elements are sequentially arranged along the second slot.

8. The mobile electronic device as claimed in claim 1, further comprising a substrate and a connector, and the ground plane, the first antenna, the second antenna, the first signal source, the second signal source, and the connector being disposed on the substrate.

* * * * *